US008413838B2

(12) United States Patent
Miller

(10) Patent No.: US 8,413,838 B2
(45) Date of Patent: Apr. 9, 2013

(54) INVERTED BOTTLE HOLDER

(76) Inventor: Alexander K. Miller, Dallas, TX (US)

( * ) Notice: Subject to any disclaimer, the term of this patent is extended or adjusted under 35 U.S.C. 154(b) by 89 days.

(21) Appl. No.: 13/051,785

(22) Filed: Mar. 18, 2011

(65) Prior Publication Data

US 2012/0234845 A1 Sep. 20, 2012

(51) Int. Cl.
*B65D 25/00* (2006.01)

(52) U.S. Cl. ..... 220/737; 220/694; 220/703

(58) Field of Classification Search ..... 220/737, 220/697, 694, 703, 738, 739, 482, 476, 324; 248/317, 690, 692, 318, 312.1; 215/390; 206/217

See application file for complete search history.

(56) References Cited

U.S. PATENT DOCUMENTS 3,589,338 A * 6/1971 Lovitz ..... 119/51.01
4,880,133 A * 11/1989 Cullinane ..... 220/737
5,435,513 A * 7/1995 Davis ..... 248/311.3
D378,040 S * 2/1997 Flint et al. ..... D7/620
D444,706 S * 7/2001 Giancaspro ..... D9/455
7,415,996 B2 * 8/2008 Favreau ..... 141/364
D650,691 S * 12/2011 Miller ..... D9/620
D650,692 S * 12/2011 Miller ..... D9/620

* cited by examiner

*Primary Examiner* — Mickey Yu
*Assistant Examiner* — Kareen Rush
(74) *Attorney, Agent, or Firm* — Bell Nunnally & Martin; Craig J. Cox

(57) ABSTRACT

An inverted bottle holder is described for holding a bottle with a neck upside down inside a container having an exterior wall. The bottle holder includes a clip having an inner wall and an outer wall spaced to accept the exterior wall of the container in between, wherein the clip is formed having a diameter corresponding to the diameter of the container, and a deck connected to the clip and extending into the container, the deck including an aperture sized to accept the neck of the bottle, such that the bottle is held upside down in the container when inserted into the aperture.

19 Claims, 4 Drawing Sheets

INVERTED BOTTLE HOLDER

TECHNICAL FIELD

The present disclosure is directed to clips for holding a bottle inverted in a drinking glass or pitcher.

BACKGROUND OF THE INVENTION

While beer and margaritas have always been popular drinks, a recent phenomenon has occurred where frozen margaritas have been combined with beer. The "beer rita" is typically made by inverting a bottle of beer into a glass or pitcher of frozen margaritas. This allows the beer to slowly combine with the margarita as it is being consumed. The popularity of the beer rita has been increasing as it has been shown on, various reality televisions shows. While simply inverting a beer bottle into a drink glass is effective, it is not always stable and the beer bottle can fall or be easily knocked out of the glass.

It would be helpful to have an inexpensive device that would hold a beer bottle more securely in a glass or pitcher. Further it would be advantageous if such a device could be used for promotions or advertising for beer or alcohol companies or restaurants or bars.

BRIEF SUMMARY OF THE INVENTION

In accordance with the concepts described herein, an embodiment of an inverted bottle holder is described for holding a bottle with a neck upside down inside a container having an exterior wall. The bottle holder includes a clip having an inner wall and an outer wall spaced to accept the exterior wall of the container in between, wherein the clip is formed having a diameter corresponding to the diameter of the container, and a deck connected to the clip and extending into the container, the deck including an aperture sized to accept the neck of the bottle, such that the bottle is held upside down in the container when inserted into the aperture.

Further in accordance with the concepts described herein, an embodiment of a method for holding a beer bottle inverted in an interior of a margarita glass is described, the method including sliding a bottle holder onto the rim of the margarita glass, where the bottle holder is formed by a deck extending into the interior of the margarita glass, the deck including an aperture sized to receive the neck of the beer bottle, and a clip integrally formed with the deck, the clip including an outer wall and an inner wall spaced to receive the exterior wall of the margarita glass. Next, the method involves inserting a neck of the beer bottle into aperture of the deck such that the bottle holder holds the beer bottle inverted in the interior of the margarita glass.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Figure 1:
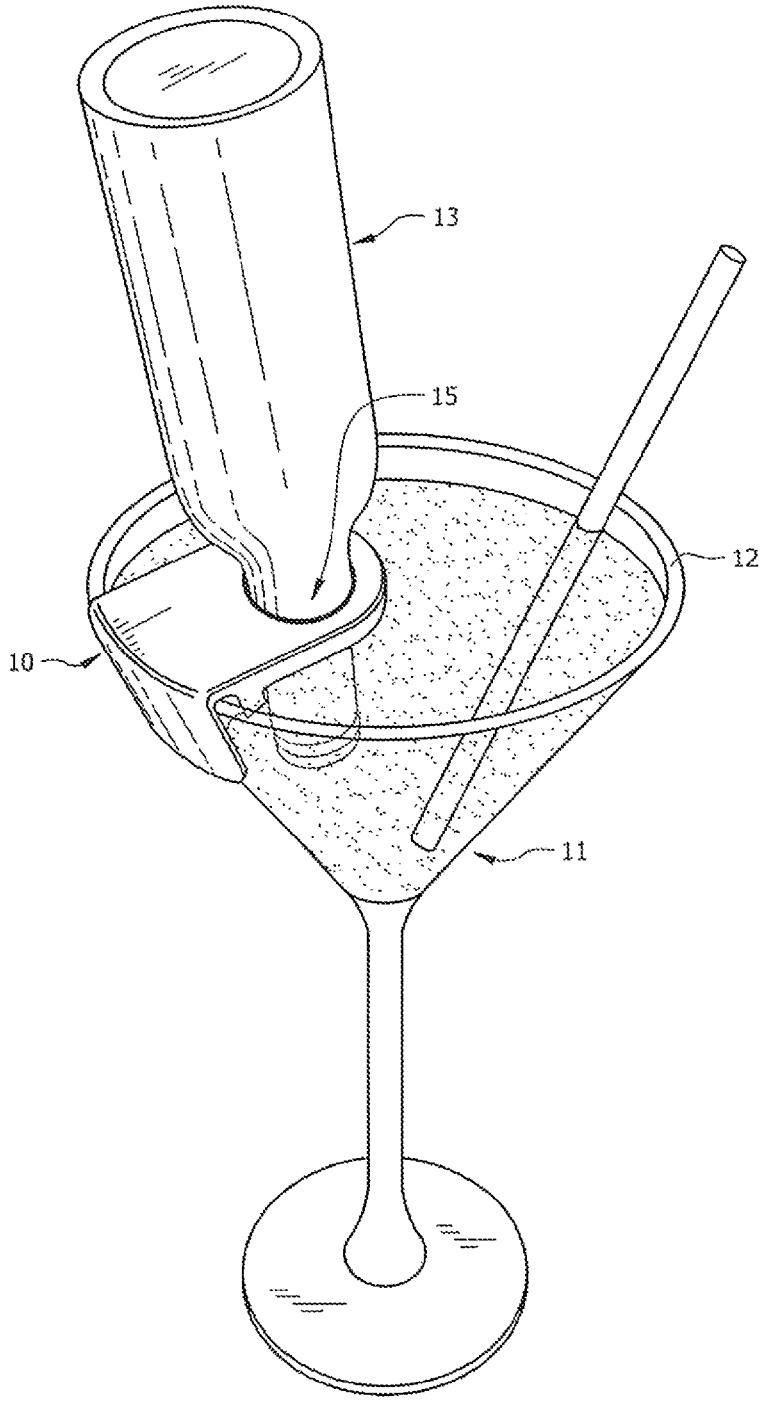
FIG. 1 is a perspective view of an embodiment of a bottle holder according to the concepts described herein holding a bottle inverted in a drinking glass.

Referring now to FIG. 1, an embodiment of a bottle holder according to the concepts described herein is shown. As described above, it has become popular to invert a bottle of beer into a frozen mixed drink to form a new type of cocktail. Most commonly a bottle of beer is inserted upside down into a frozen margarita to create a "beer rita." While this is the most popular example of such a drink, any types of beverages could be used, alcoholic or non-alcoholic. Typically, the bottle is set into the glass or pitcher and rests against the edge of the glass or pitcher. Unfortunately, a bottle in that position can be prone to falling or being knocked out of the glass or pitcher. The present invention describes a bottle holder that can be used to hold a bottle inverted in glass in a more stable manner.

Bottle holder 10 is an embodiment of a device to hold an inverted bottle in a glass or pitcher according to the concepts described herein. Bottle holder 10 is positioned on glass 11 by sliding it onto the rim 12, such that it is held securely on the glass. A bottle 13 can then be inserted upside down into an aperture sized to receive the neck 15 of the bottle in bottle holder 10 such that the bottle is held inverted in the glass 11.

Figure 2:
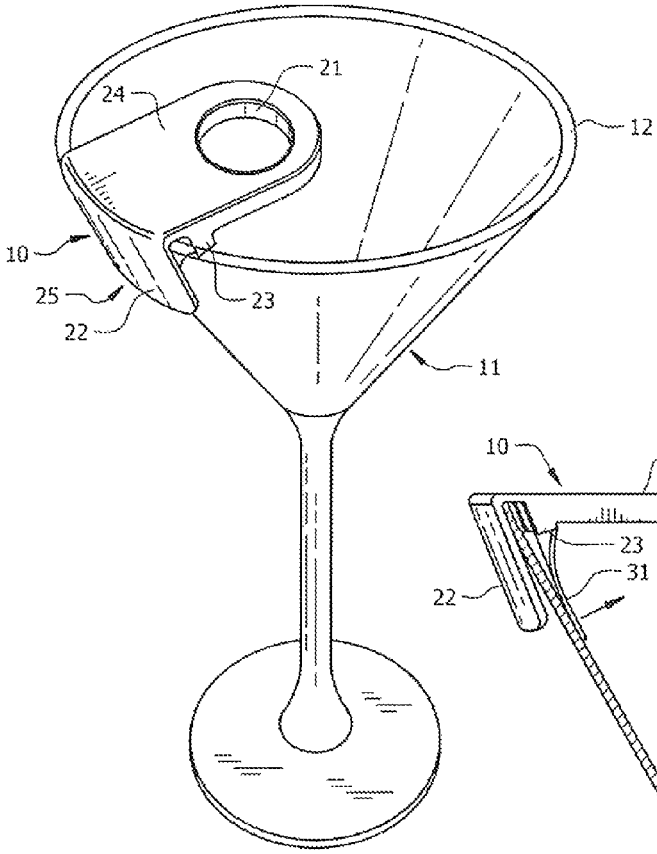
FIG. 2 is a perspective view of an embodiment of a bottle holder according to the concepts described herein on a drinking glass without the inverted bottle.
Figure 3:
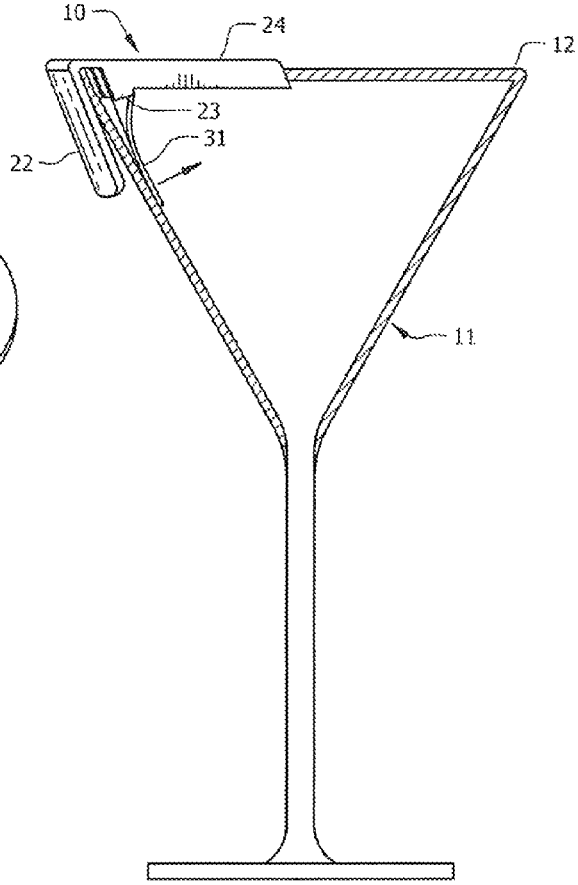
FIG. 3 is a side view of an embodiment of a bottle holder according to the concepts described herein shown on a cutaway of a drinking glass.
Figure 4:
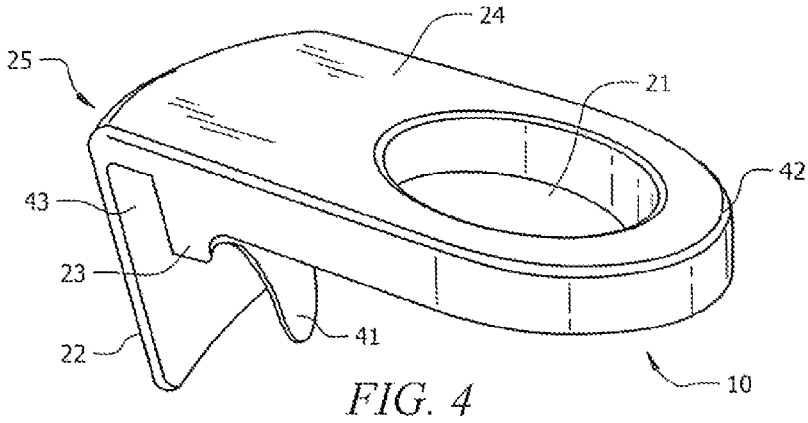
FIG. 4 is a perspective view of an embodiment of a bottle holder according to the concepts described herein.
Figure 5:
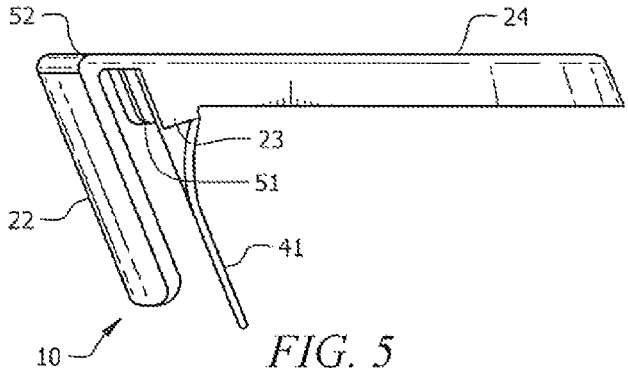
FIG. 5 is a side view of an embodiment of the bottle holder shown in FIG. 4.
Figure 6:
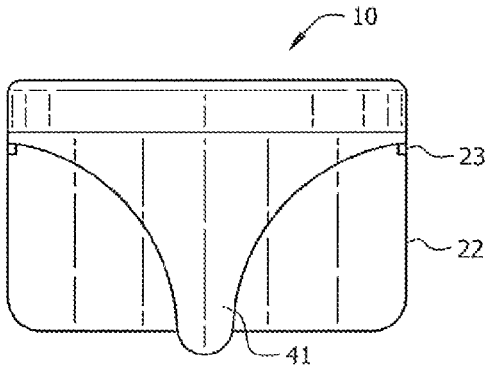
FIG. 6 is a front view of an embodiment of the bottle holder shown in FIG. 4.

Referring now to FIGS. 2-3, the embodiment of bottle holder 10 is described in more detail. Bottle holder 10 is formed by deck 24 and clip 22. Deck 24 is attached to, or formed integrally with, clip 22 and includes aperture 21. Aperture 21, shown in this embodiment as a circular cutout in deck 24, is sized to receive neck of a typical beer or soda bottle, but is smaller than the main diameter of the bottle such that the neck of the bottle will extend through aperture 21 but the remainder of the bottle will be held in place by the surface of deck 24 as the shoulders of the bottle, where the bottle transitions from the neck to the main portion, rest against the edges of the aperture and the upper surface of deck 24.

Clip 25 of bottle holder 10 includes outer wall 22 and inner wall 23. Bottle holder 10 is held in place on rim 12 of glass 11 by positioning the wall of the glass between outer wall 22 and inner wall 23. Outer wall 22 and inner wall 23 preferably are formed in a curve having the same diameter as the glass or pitcher so that bottle holder 10 fits easily over the glass. While an identical diameter is ideal, small variations between the glass diameter and the clip diameter can occur without substantially affecting the fit of bottle holder 10 on glass 11.

Referring now to FIGS. 4-8, a preferred embodiment of bottle holder 10 is described in greater detail. As described above, bottle holder 10 is formed by a deck 24, having a aperture 21 to accept the neck of a bottle, and clip 25. Edge 42 of deck 24 can be beveled to provide a pleasing appearance to bottle holder 10. Clip 25 includes outer wall 22 and inner wall 23 which hold the wall of a glass or pitcher between them when the bottle holder is in use. An upper wall 52 of clip 25, adjacent to deck 24, comes to rest on the rim of the glass when inserted. Though inner wall 23 can be of any suitable shape, in a preferred embodiment inner wall tapers into tongue 41. The taper in inner wall 23 allows for easier fit onto the rim of the glass. Also, in a preferred embodiment inner wall 23 is thinner than outer wall 22 and can be slightly flexible also to aid in proper placement.

Figure 7:
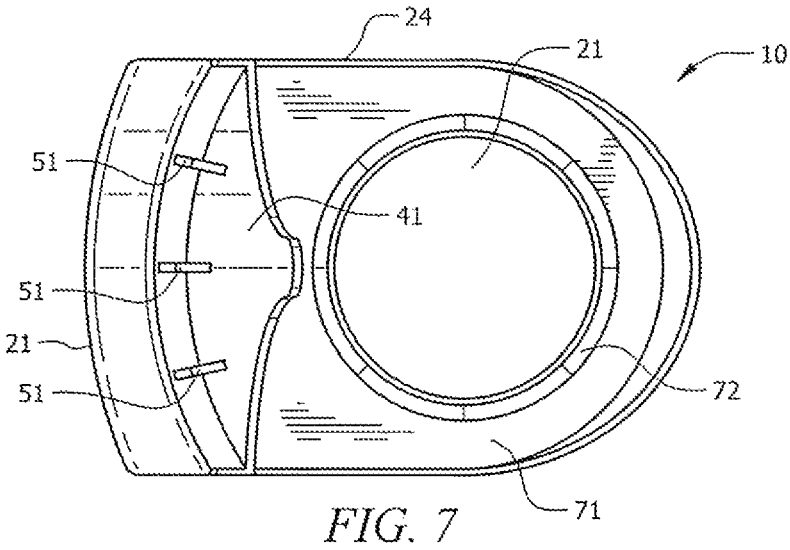
FIG. 7 is a bottom view of an embodiment of the bottle holder shown in FIG. 4.
Figure 8:
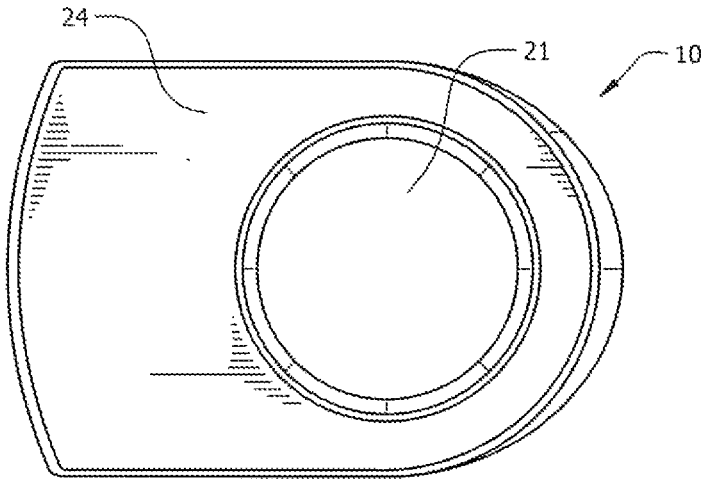
FIG. 8 is a top view of an embodiment of the bottle holder shown in FIG. 4.

Clip 25 is also preferably formed at an angle to deck 24, the angle corresponding to an angle of the glass, as shown in FIGS. 1-3. While a slightly acute angle is shown in FIGS. 4-8, clip 25 can be formed at any angle required by the glass or pitcher on which it is to be installed. Clip 25 also has a diameter, again to match the glass or pitcher onto which it is intended to be applied. In certain embodiments, support ridges 51 can be formed on the inner wall 23 providing additional structural support. As shown in FIG. 7, aperture 21 can be formed with a ring wall 72 extending below bottom surface 71 of deck 24. Ring wall 72 provides additional strength to deck 24 and additional support for the neck of a bottle inserted into aperture 21.

As an additional feature in certain embodiments of bottle holder 10, there is space on both deck 24 between aperture 21 and clip 25 for promotional or advertising material to be added to clip 10. Additional space for promotional or advertising material can be found on the exterior surface of outer wall 22 of clip 25. Clip 25 can be formed from any suitable material, but is preferably a plastic having enough strength to support a full bottle inserted into aperture 21 while bottle holder 10 is sitting on the rim of a glass or pitcher.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An inverted bottle holder intended to hold a bottle with a neck upside down inside a container when attached thereto, the container having an exterior wall having an arc and oriented at an angle with respect to the vertical orientation of the container, the bottle holder comprising:

a clip having an inner wall and an outer wall spaced to accept the exterior wall of the container in between, wherein the clip is formed at an arc corresponding to the arc of the exterior wall of the container; and a deck connected in a permanently fixed relationship to the clip and extending into the container, the deck including an aperture sized to accept the neck of the bottle, such that the bottle is held upside down in the container when inserted into the aperture.

2. The inverted bottle holder of claim 1 wherein the clip is at an angle to the deck, the angle corresponding, to the angle of the exterior wall of the container.

3. The inverted bottle holder of claim 1 wherein the interior wall tapers as it extends from a top edge of the clip.

4. The inverted bottle holder of claim 1 wherein the aperture includes an inner ring wall.

5. The inverted bottle holder of claim 1 wherein the deck includes a space for displaying promotional material.

6. The inverted bottle holder of claim 1 wherein outer wall of the clip includes a space for displaying promotional material.

7. The inverted bottle holder of claim l wherein the bottle the inverted bottle holder is intended to hold is a beer bottle.

8. The inverted bottle holder of claim 1 wherein the container the inverted bottle holder is intended to he attached to is a margarita glass.

9. The inverted bottle holder of claim 1 wherein the deck and the clip are integrally formed from molded plastic.

10. A bottle holder intended to hold a beer bottle having a neck inverted in a margarita glass, the margarita glass having an arc and an exterior wall oriented at an angle with respect to the vertical orientation of the margarita glass, the bottle holder comprising:

a deck extending into the interior of the margarita glass, the deck including an aperture sized to receive the neck of the beer bottle; and a clip integrally formed in a permanently fixed relationship with the deck, the clip including an outer wall and an inner wall spaced to receive the exterior wall of the margarita glass, wherein the clip is curved at the same arc as the margarita glass and is formed at an angle to the deck corresponding to the angle of the exterior wall of the margarita glass.

11. The bottle holder of claim 10 wherein the interior wall tapers as it extends from a top edge of the clip.

12. The bottle holder of claim 10 wherein the aperture includes an inner ring wall.

13. The bottle holder of claim 10 wherein the deck includes a space for displaying promotional material.

14. The bottle holder of claim 10 wherein outer wall of the clip includes a space for displaying promotional material.

15. The bottle holder of claim 10 wherein the inner wall of the clip includes reinforcing walls.

16. The bottle holder of claim 10 wherein the bottle holder is formed from plastic.

17. A method for holding a beer bottle inverted in an interior of a margarita glass, the margarita glass having an arc and an exterior wall oriented at an angle with respect to the vertical orientation of the margarita glass, the method comprising:

sliding a bottle holder onto the rim of the margarita glass, the bottle holder comprising:

a deck extending into the interior of the margarita glass, the deck including an aperture sized to receive the neck of the beer bottle; and a clip integrally formed in a permanently fixed relationship with the deck, the clip including an outer wall and an inner wall spaced to receive the exterior wall of the margarita glass; and inserting a neck of the beer bottle into aperture of the deck such that the bottle holder holds the beer bottle inverted in the interior of the margarita glass.

18. The method of claim 17 further comprising displaying promotional material on the upper surface of the deck.

19. The method of claim 17 further comprising displaying promotional material on the outer surface of the outer wall of the clip.

* * * * *